US005322530A

United States Patent [19]

Merriam et al.

[11] Patent Number: 5,322,530

[45] Date of Patent: Jun. 21, 1994

[54] PROCESS FOR CLEAN-BURNING FUEL FROM LOW-RANK COAL

[75] Inventors: Norman W. Merriam; Vijay Sethi; Lee E. Brecher, all of Laramie, Wyo.

[73] Assignee: Western Research Institute, Laramie, Wyo.

[21] Appl. No.: 963,793

[22] Filed: Oct. 20, 1992

[51] Int. Cl.[5] ..... C10L 5/00

[52] U.S. Cl. ..... 44/608; 44/620

[58] Field of Search ..... 44/608, 620, 621, 501, 44/607; 201/31, 23

[56] References Cited

U.S. PATENT DOCUMENTS

| | | | |
|---|---|---|---|
| 4,249,909 | 2/1981 | Comolli | 44/608 |
| 4,396,394 | 8/1983 | Li et al. | 44/608 |
| 4,401,436 | 8/1983 | Bonnecaze | 44/608 |
| 4,402,706 | 9/1983 | Wunderlich | 44/608 |
| 4,421,520 | 12/1983 | Matthews | 44/620 |
| 4,448,666 | 5/1984 | Wallman | 201/31 |
| 4,495,710 | 1/1985 | Ottoson | 34/10 |
| 4,498,905 | 2/1985 | Skinner | 44/608 |
| 4,501,551 | 2/1985 | Riess et al. | 44/501 |
| 4,511,363 | 4/1985 | Nakamura et al. | 44/608 |
| 4,533,438 | 3/1985 | Michel et al. | 201/31 |
| 4,668,244 | 5/1987 | Nakamura et al. | 44/591 |
| 4,775,390 | 10/1988 | Bixel | 44/501 |
| 4,783,200 | 11/1988 | Bixel et al. | 44/501 |
| 4,828,576 | 5/1989 | Bixel et al. | 44/501 |
| 4,943,367 | 7/1990 | Nixon et al. | 208/131 |
| 5,087,269 | 2/1992 | Cha et al. | 44/626 |

OTHER PUBLICATIONS

Jacobsen et al., "The Role of Coal Preparation in the Pre-Combustion Control of Hazardous Air Pollutants," Proceedings of American Mining Congress: Coal Preparation, 82-99, Cincinnati, Ohio, May 1992.

*Primary Examiner*—John Niebling
*Assistant Examiner*—Edna Wong
*Attorney, Agent, or Firm*—John O. Mingle

[57] ABSTRACT

A process for upgrading and stabilizing low-rank coal involving the sequential processing of the coal through three fluidized beds; first a dryer, then a pyrolyzer, and finally a cooler. The fluidizing gas for the cooler is the exit gas from the pyrolyzer with the addition of water for cooling. Overhead gas from pyrolyzing is likely burned to furnish the energy for the process. The product coal exits with a tar-like pitch sealant to enhance its safety during storage.

2 Claims, 1 Drawing Sheet

PROCESS FOR CLEAN-BURNING FUEL FROM LOW-RANK COAL

This invention was made with Government support under DE-FC21-86MC11076 awarded by the Department of Energy. The Government has certain rights in this invention.

BACKGROUND OF INVENTION

1. Field of Invention

The present invention relates to processing low-rank coals in fluidized beds to upgrade them to stabilized clean-burning fuel with high heating values.

2. Background

The upgrading processing of coal can take a number of forms such as drying, pyrolysis and mild gasification.

Coal is dried for a variety of reasons, such as to save on transportation costs, to increase the heating value, to increase the net dollar value, to prevent handling problems caused by freezing weather, to improve coal quality particularly when used for coking, briquetting, and producing chemicals, to improve operating efficiency and reduce maintenance of boilers, and to increase coke oven capacity. However drying of coal causes increased dust formation as the dry coal is more friable. Further readsorption of moisture of dried coals is considered a potential problem.

Dry coal is generally preferred in many coal operations. In World War II the Germans determined that dry coal improved pyrolysis in Lurgi-Spulgas ovens, while the French found that the capacity of coking ovens was increased by using said coal. Thus increased tonnages of dry coal were being sold in the United States up to the early 1970s when stringent emission standards elevated its cost to an uneconomic level.

Another trend in the coal mining industry was its increased mechanization resulting in an increased percentage of coal fines. Because coal fines have a greater relative surface area, they are very susceptible to water adsorption. In order to market such fines, drying was necessary.

Difficulties in coal drying abound. Besides the stringent emissions standards adding an economic burden, numerous explosions and fires have occurred when low cost air is employed as the drying medium. Coal dust fines are more susceptible to dust explosions than are larger particles, and often dry coal is treated with heavy oil before shipping to prevent dust formation and the readsorption of moisture. Adding heavy oil to dry coal is a common method to prevent moisture readsorption and autogenous heating, but in so doing increases operating costs.

Other fluids sometimes employed to treat dried coal to prevent moisture readsorption and autogenous heating include vinyl acetate, vinyl acetate/acrylic polymers, styrene-butadiene, acrylic latex or resins, natural gums or resins, tall oil, neoprene, rubber and the like; however, it is common to keep the halogen content low or preferably none since halogens are detrimental to subsequent boiler operation.

Many proposed processes for upgrading coal involve fine grinding and separations in liquid media. The resulting cleaned coal is difficult to handle using conventional techniques because of fine particles and high moisture contents. Additional drying is sometimes employed; however, moisture readsorption, dust formation with its fire and explosion hazards, and spontaneous heating often result in unstable products.

The general problem of coal drying represents removing three types of moisture: free, physically bound, and chemically bound. Free moisture is found in the very large pores and interstitial spaces of coal and often is removed by mechanical means as it exhibits the normal vapor pressure expected of water at that temperature.

Physically bound moisture is more difficult to remove as it is held tightly in small coal capillaries and pores. Because of this, its vapor pressure and specific heat are reduced over that expected of free moisture.

Chemically bound moisture is characterized by a bonding between surfaces and water. Monolayer and multilayer bonding are commonly identified.

Sometimes a fourth type of moisture is identified which comes from the decomposition of organic compounds. It is really not moisture held in coal but is produced during coal decomposition.

Coal drying is characterized by typical drying curves that exhibit distinct rate regions. Firstly, a transient region occurs as equilibrium conditions are sought while the material heats. This is followed by a largely constant rate portion of drying where the material temperature is relatively constant during the unbound moisture removal, and the drying rate is generally determined from only the particle size and moisture content, be it coal or some other material.

The final region is a period of decreasing rate as the material temperature increases and the physically and chemically bound moisture is removed. For this drying regime the particle size, temperature, and residence time are important parameters. Often the drying rate becomes diffusion controlled, and since diffusivity increases with temperature, higher temperatures are employed to continue drying the materials.

During the constant rate period, the heat and mass transfer rates are directly proportional to the driving forces of temperature gradient and humidity gradient respectively; the appropriate proportionality constants, however, are usually experimentally determined. Maintaining large values of said gradients become important when efficient drying equipment is designed; however, if drying residence time is increased easily, such gradients become less important.

For many coals with higher moisture content, the most important variable is often the degree of fines produced for higher velocity drying gases pick up more such fines.

A variety of drying techniques to upgrade low rank coals include hot water and steam drying under pressure and hot-gas drying using a rotary kiln, Roto-Louvre dryer or a Perry turbulent entrainment dryer. Many coals when dried directly in hot gases readsorb moisture and return to nearly the original equilibrium moisture level. In contrast both steam and hot-water drying reduce moisture readsorption.

Another drying factor for ultra-fine coal besides fines carryover is explosions. Since indirect heating is inefficient as it requires large heat transfer surfaces with a separate heating medium that escalates capital cost and leads to high maintenance requirements and low throughput, ideally an inert atmosphere is needed with a low gas velocity.

After World War II fluidized bed dryers were adapted to coal drying; however, critical control of both coal and gas flow was required in order to avoid fires and explosions. McNally Flowdryer, Dorr-Oliver Fluo-Solids Dryer, Link-Belt Fluid Flow Dryer, and Heyl and Patterson fluidized bed dryers are all well known.

Typically fluidized bed dryers have a coal-fired zone, using stokers or pulverized coal pneumatically injected, where fluidizing air is heated and its oxygen content reduced. Another zone acts as the dryer where the pressure drop across the gas distributor is large relative to the pressure drop across the bed in order to assure good dryer gas distribution. In some installations, gas from the coal is recycled to further reduce the oxygen concentration. Coal distribution is controlled by a feeder-spreader device, such as a roll feeder, multiple screw feeders, or grate.

These fluidized bed dryers are potentially hazardous when air or mixtures of air and recycled gas are employed. The oxygen concentration is critical to avoid explosive conditions, and special safety equipment, such as sprinkler systems, blowout doors, and automatic fail-safe shutdown devices, is common. Additionally the moisture content of the dry coal is often held to relatively high value of 5–10%, or 0.5–1.0% surface water, to make the drying operation less hazardous and to avoid excessive formation of dust. After removal of the surface water, the rising bed temperature becomes the control parameter to keep it safely below auto-ignition conditions.

Equipment to control particulate emissions from fluidized beds include combinations of cyclones, electrostatic precipitators, bag filters, and wet scrubbers. Cyclones are ineffective with particle sizes below five microns, so their operation is usually restricted to extraction of large particle dust loading prior to removal of fine dust particles by subsequent equipment. However cyclones employed at the gas stream dew point or with water-spraying, are nearly as effective as wet scrubbers. Electrostatic precipitators must be kept free of condensation, and in addition, are subject to malfunctions and frequent maintenance.

Flash dryers use entrained fluidized beds to dry particles under residence times of one second or less. This short residence time gives a high capacity with a low inventory of coal and makes them less hazardous than conventional fluidized bed dryers. Yet particle fines entrainment due to the required high gas velocity is a problem and requires additional separation equipment.

In many instances when further operations are performed on the dried coal, these safety problems are transferred from the dryer region to the other process, such as pyrolysis, and product storage.

Pyrolysis of coal takes many forms often concentrating on the various products of mild gas, hydrocarbon liquids and solid char. Before 1940 many world-wide coal processing plants operating with low temperature pyrolysis produced one of more of these products for the commercial market.

With the advent of an international distribution system for petroleum after World War II, low temperature devolatilization of coal rapidly declined, and many such plants were shutdown. When the petroleum shortages appeared after 1970, increased interest in such processes reappeared; however, with the utilization of modern fluidized bed technology, which featured high sweep gas rates, small particle sizes and allowed rapid heating of high-volatile coals, improved yields occurred.

In the United States the development of synfuel processes occurred after 1960. The COED process used a series of fluidized beds to stepwise carbonize caking coals at higher and higher temperatures. The Clean Coke method utilized a fluidized bed devolatilizer while an entrained bed reactor for flash devolatilization was employed by Occidental.

After 1960 European mild gasification processes did produce briquettes from various fines; however, coal tars from this process produced by flash devolatilization have been of poor quality consisting of heavy, highly aromatic components with high melting points. Further, the high dust content has been an additional problem.

In the United States most recent development concentrated on high temperature, high pressure processes designed to produce maximum yields of liquid and gaseous products; however, economic concerns have not been favorable for commercial exploitation. Currently mild gasification plants are not competitive with petroleum in the United States.

Whereas previously much pyrolysis was designed to obtain maximum yields of liquid and gaseous products, modern operations now concentrate upon well-controlled partial pyrolysis designed to produce selected outputs that are recycled within the process to make the final processed coal product.

Prior art United States patents covering the above mentioned fluidized bed processing concepts of coal drying and coal pyrolysis include:

| U.S. Pat. No. | Inventor | Year |
|---|---|---|
| 4,943,367 | Nixon et al | 1990 |
| 4,828,576 | Bixel-1 et al | 1989 |
| 4,783,200 | Bixel-2 et al | 1988 |
| 4,775,390 | Bixel-3 | 1988 |
| 4,668,244 | Nakamura et al | 1987 |
| 4,533,438 | Michel et al | 1985 |
| 4,501,551 | Riess et al | 1985 |
| 4,498,905 | Skinner | 1985 |
| 4,495,710 | Ottoson | 1985 |
| 4,421,520 | Matthews | 1983 |
| 4,402,706 | Wunderlich | 1983 |
| 4,401,436 | Bonnecaze | 1983 |
| 4,396,394 | Li et al | 1983 |
| 4,249,909 | Comolli | 1981 |

Referring to the above list. Nixon et al disclose an inert gas fluidized bed flash pyrolysis of coal utilizing high heating rates to produce a desirable tar fraction that is condensed and then coked.

Bixel-1 et al disclose a dried coal process where a treating agent to prevent spontaneous ignition is selected from the group consisting of foots oils, petroleum filtrate, and hydrocracker recycle oil. Bixel-2 et al disclose a dried coal process where a heavy cycle or light cycle oil or slurry oil is employed as a treating agent to prevent spontaneous ignition. Bixel-3 discloses a dried coal process where a treating agent to prevent spontaneous ignition is light cycle oil, heavy cycle oil, clarified slurry oil, a petroleum or coal derived distillate, a solution of durene in gasoline and mixtures of two or more of the preceding.

Nakamura et al disclose a method employing screw reactors with improved sealing between stages for upgrading low rank coal; he uses a carbonizing step after drying and subsequent below 100° C. tar treatment by recycled material. Michel et al disclose a two stage fluidized bed coal drying and pyrolysis process with several heat recovery aspects. Riess et al disclose a fluidized bed method of coal drying to obtain a coal product resisting spontaneous ignition by using fine particle separation and deactivating fluid.

Skinner discloses a method for controlling the dusting tendencies of dried coal by treating with a heavy deactivating oil and a light dedusting oil. Ottoson discloses a process for fluidized bed coal drying where rapid heating to mobilize tar is followed by cooling using a recycle stream. Matthews discloses drying coal and treating it for spontaneous ignition with a deactivating dispersion fluid of milled latex paint type solids emulsified with water.

Wunderlich discloses drying coal and then processing with a controlled oxidation to lower its spontaneous ignition. Bonnecaze discloses drying coal and then cooling it with a controlled stream of water. Li et al disclose drying coal with a reduced tendency to spontaneously ignite by cooling it to below 100° F. Comolli discloses a hot gas, moving bed wicking-up or volitation and recondensation process where coal hydrocarbons prevent moisture readsorption.

In modern times a concern for the discharge of heavy metals and alkalis from coal processing has occurred. For more information see, Jacobsen et al. "The Role of Coal Preparation in the Precombustion Control of Hazardous Air Pollutants", Proceeding of American Mining Congress: Coal Preparation, page 82–99, Cincinnati, Ohio, May 1992.

SUMMARY OF INVENTION

The objectives of the present invention include overcoming the above-mentioned deficiencies in the prior art by providing a process employing fluidized beds that upgrades and stabilizes low-rank coal to produce high heating value clean-burning fuel while concentrating on keeping the economics of the process favorable by minimizing the capital cost of equipment.

DETAILED DESCRIPTION OF INVENTION

Figure 1:
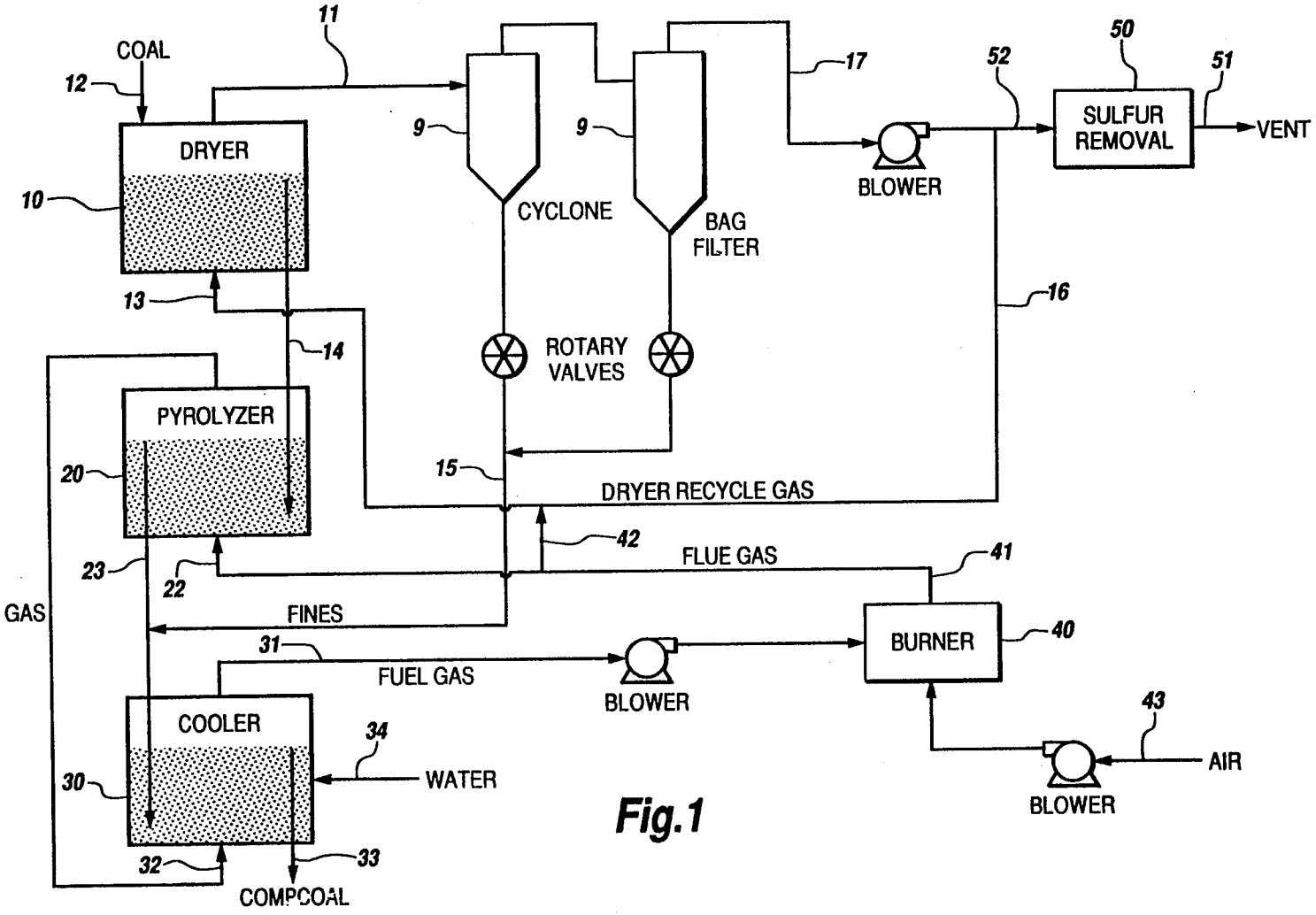
FIG. 1 shows a typical process of upgrading and stabilizing low-rank coal; the product coal is referred to as Compcoal in this drawing.

The flow sheet of the subject process is shown in FIG. 1 for a typical configuration. Raw coal 12 containing a high moisture content, such as 20–30 percent, that is normally found in Western Coals such as the powder River Basin (PRB), is crushed and fed into a conventional fluidized bed dryer 10. The hot gas for the dryer 13 with a temperature in the range of about 400°–700° F. is composed of a mixture of recycled drying gas 16 and new flue gas 42, often called combustion gas since it represents the combustion of hydrocarbons, coal fines, or external fuel to produce a high temperature gas. This drying gas has relatively low oxygen content and does not create a hazardous situation with the dried coal and its fines. The flow rate for said dryer fluidizing gas is adequate to operate a fluidized bed and heat the bed particles up to a maximum temperature of 350° F., although lower temperatures are often employed. The preferred coal temperature is about 250° F. since adequate drying can occur without excess carbon dioxide being generated from beginning pyrolysis. The coal 14 leaving the dryer is substantially bone-dry as it enters the next stage pyrolyzer 20. The dryer overhead stream 11 contains considerable coal fines which are removed by a fines removal system 9 often involving cyclones and bag filter. Such fines 15 are consolidated and recycled into the partly processed coal stream 23 leaving the pyrolyzer 20. The overhead 17 from the fines removal system 9, now fines-free gas, is partly recycled 16 back to the dryer 10, and partly passed 52 through a sulfur removal unit 50 before venting 51. Because of the various recycled streams, only one sulfur removal unit 50 is required for the entire process. The PRB coal is low sulfur as mined; however, this process concentrates the sulfur concentration of the dryer gas stream by its choice of recycling arrangements; thus, sulfur removal is necessary before venting. Alternatively, the overhead fines-free gas 17 can have the water condensed for other use, such as recycling back to use as water spray 34 in the cooler 30.

The pyrolyzer 20 is a conventional fluidized bed where the solid material feed 14 comes from the dryer 10 discharge. The fluidizing gas is hot flue or combustion gas 22, and normally is about 300° F. higher than the desired maximum particle temperature in this pyrolyzer 20. The pyrolyzer 20 operates to produce a bed particle temperature in the range of about 600°–1100° F. with a preferred temperature of about 900° F. This temperature is usually high enough to produce adequate pyrolysis to fuel the system, but low enough not to degrade greatly the heating value of the volatile's content of the product coal. Another factor is often the control of the sulfur ending up in the product coal 33 for a higher pyrolysis temperature will drive more of the sulfur into the gaseous component 21 for eventual removal 50. Further a higher temperature will also drive more of the heavy metals and alkalis from the coal. The pyrolyzer overhead 21 must contain adequate tar-like pitch in the vapor state to coat the product coal 33 from the cooler 30 with approximately a range of 6–9 weight percent, preferably about 8 percent, tar-like pitch sealant. This seals the product coal against readsorption of moisture, keeps the dustiness index due to fines under control, and largely prevents spontaneous combustion. The partly processed coal 23 leaving the pyrolyzer 20 has added to it the fines stream 15 and enters the cooler 30.

The cooler 30 is a conventional fluidized bed operating with a feed largely from the discharge 23 of the pyrolyzer 20 and a fluidizing gas 32 coming from the overhead stream 21 of the pyrolyzer 20. In order to cool the particle coal to below about 400° F., and preferably near approximately 220° F., appropriate water 34 is sprayed over the bed. This cooler condenses adequately the tar-like pitch contained by fluidizing stream 32 onto the particles of coal forming the final product coal 33, now containing approximately 6–9 weight percent tar-like pitch, discharged from the cooler 30. This product coal 33 is referred to as Compcoal in FIG. 1. The quantity and composition of the tar-like pitch deposited upon the pyrolyzed coal is controlled by the temperature of the fluidized bed in the cooler 30. The overhead stream 31 from the cooler 30 contains hydrocarbons and some noncondensed tar-like pitch and is used as a fuel gas for the burner 40 producing combustion or flue gas 41, with a temperature of approximately 900°–1400° F., for use as the heat source for the dryer 10 and pyrolyzer 20. Alternatively external fuel is employed to provide fuel for the combustor. The burner 40 is fed appropriate air 43 to insure adequate combustion but not high enough to increase the oxygen content of the dryer gas to an unsafe level.

All the fluidized beds normally operate in the reasonable range of gas fluidizing velocities of from one to two times the minimum fluidization velocity; however, higher fluidization velocities can be tolerated if freeboard design is appropriate to handle the coal fines generated.

Since part 42 of the combustion or flue gas 41 combines with recycled dryer gas 16, sulfur in such gas eventually enters the sulfur removal unit 50; however, the sulfur removal can be alternatively placed in the cooler exit gas stream 31 rather than the dryer exit gas stream 52.

In a further embodiment the removal of heavy metals and alkalis is performed if their concentration becomes excessive. A removal unit could be installed in the dryer exit gas 52 or the cooler exit gas 31.

EXAMPLE 1

In order to dry coal, it was necessary first to investigate its characteristics in order to determine the necessary temperature settings for the fluidized bed operations. Tests on typical coals employed in these drying operations are well summarized in U.S. Pat. No. 5,087,269; whose specification hereby is incorporated by reference.

These conversion studies indicate that significant pyrolysis conversion started at near 475° F. with predominately carbon dioxide formed as the gaseous product below 750° F.; however, as the carbon dioxide formed, these pyrolysis reactions did also produce considerable liquid tar. For adequate amounts of vapor tar-like pitch to form, pyrolysis temperatures in the range of about 900°-1000° F. were needed.

EXAMPLE 2

From the above Example 1 information the preferred embodiment operating conditions were to keep the bed temperature below 400° F. for only drying, and this was potentially as low as 140° F. depending upon the fines produced; however, a preferable temperature was about 250° F. which produced the evolution of moisture without allowing any significant pyrolysis to occur.

The next step introduced rapid heating which produced pyrolysis and did evolve carbon dioxide, tar, and various hydrocarbons; the best operating condition was near about 950° F. The expected operating range was from about 600°-1100° F. This pyrolysis had a number of tradeoffs. First was to produce sufficient tar-like pitch in the gas stream to adequately seal the processed coal in the next step. Then the heating value of the fuel gas produced was taken into account. The higher the pyrolysis temperature the more hydrocarbons appear in this fuel gas which was potentially adequate to create by combustion the needed energy for the process. Further this pyrolysis temperature affects the amount of sulfur as well as heavy elements and alkalis that was cleaned from the system before venting the combustion products. Thus depending upon the original coal composition this pyrolysis temperature was potentially controllable over a wide range.

The next cooling step quenched to below 400° F. which did stop the pyrolysis, and slowed the flow of the tar. However this cooling stage temperature was primarily governed by the tar-like pitch condensation, and since water was a likely cooling mechanism, although under some circumstance raw coal having a large moisture content was potentially employed for this cooling, a temperature near about 220° F. was a likely operating value, although a range from 220°-400° F. was effectively employed. If hot coal was discharged, however, oxidation from contact with air was a possible problem; thus, about 400° F. was considered a likely upper limit.

EXAMPLE 3

A separate sample of PRB coal was employed to determine the product coal properties. A standard heating value of near 12000 Btu/lb represented the intermediate dried coal while the char from pyrolysis obtained a 13200 limit; however, a value of about 12500 for the product coal was projected as a commercial operation result. Therefore operating conditions of the process were set to make a product having about 12500 Btu/lb heating value. Most product experiments produced coal within 10 percent of this targeted value.

EXAMPLE 4

The tar-like pitch needed to stabilize the coal was condensed in the cooler from the fluidizing gas stream directly onto the fluidized coal. This pitch was produced in the pyrolysis unit and retained in its gas stream which then became the input fluidizing gas for this cooling unit. The desired tar-like pitch was defined as that obtained by condensing liquids at 700° F. from high-temperature mild gasification pyrolysis of PRB coal and was commonly called "700° F. pitch", and this represented the common terminology of tar-like pitch or tar-like pitch sealant referred to often in this invention. This represented a part of the tar or pitch referred to in Example 1.

A desired treating amount was 8 weight percent tar-like pitch, which was estimated as equivalent to about 15 gallons of oil per ton of product coal as determined by previous tests and other information; for instance U.S. Pat. Nos. 4,775,390; 4,783,200; and 4,828,576, the specifications of which are hereby incorporated by reference. These treated dried coal by recommending 0.2 to 5.0 gallons of oil per ton of coal when applied specifically in a separate special step, and this converted into 0.1 to 2.7 weight percent. The current invention used somewhat higher amounts in the broad range of 1 to 9 weight percent because the control over the process was less exacting. Using previous mild gasification data, it appeared that about three times the largest amount needed was potentially available in the gas stream under a wide range of pyrolysis operating conditions. Therefore adequate tar-like pitch was potentially present in the fluidizing stream for the third stage, and when adequate cooling occurred, coated the char to form the product dried coal. However test results again showed a wide variation of from 2 to 5 percent tar-like pitch in the product. Yet despite this wide range, the product tested adequate for stability and reduced readsorption of moisture.

The type of oil or oil-like material used for dried coal treating can be many and varied. Sometimes it is referred to as just heavy oil. From the above referenced patents this oil-like material can be selected from vinyl acetate, vinyl acetate/acrylic polymers, styrene-butadiene, acrylic latex or resins, natural gums or resins, tall oil, neoprene, rubber, foots oils, petroleum filtrate, hydrocracker recycle oil, light cycle oil, heavy cycle oil, clarified slurry oil, a petroleum or coal derived distillate, a solution of durene in gasoline, and combinations thereof.

In an alternate configuration the treating by oil of the product coal could occur separately if insufficient tar-like pitch was present in the coolant fluidizing gas, if the discharge char from the pyrolyzer was not immediately cooled, or if a cooling section is omitted entirely.

EXAMPLE 5

A bench scale unit was employed to produce product coal to test for needed properties involving dustiness and readsorption of moisture. For these tests a pyrolysis temperature of about 1000° F. was employed while the temperature of the pitch coating bed varied from 325°-397° F.

Dustiness was measured by employing ASTM D441-86 slightly modified for the crushed coal sizes. A one-tenth scale tumbler was employed because of the use of small sample sizes. This standard procedure determined the weight percent minus 50 mesh material and this averaged 1.0 percent dust index for the product coal where the tar-like pitch sealant averaged 7.6 weight percent. The same procedure run on feed coal produced a 1.7 percent dust index. In this procedure a higher index represented more dust. These values indicated that the product coal was slightly better than the original raw coal and certainly no worse.

For the readsorption of moisture ASTM D-1412 was employed slightly modified by not prior crushing the samples since no alternation of the surface characteristics was desired. It gave an equilibrium moisture content of from 6-12 percent depending upon the degree of coating. Conversely the same test applied to raw feed coal produced a value in the range 13-15 percent. Therefore with this lower equilibrium moisture content, the product coal showed a significant improvement.

Another factor of interest was spontaneous ignition or self-combustion which test procedure was detailed in U.S. Pat. No. 5,087,269 whose specification has previously been incorporated by reference. The current results involved an average of 7.6 weight percent of tar-like pitch sealant deposited on the product coal. The time to ignition was an average of about 72 hours for the raw feed coal, about 9.5 hours for the uncoated char from the pyrolyzer, and about 23.5 hours for the treated product. Thus a significant reduction in the tendency for spontaneous ignition occurred with this particular treated product. Adequate improved results were expected for other lower sealant amounts.

EXAMPLE 6

Tests were performed on the char produced in the pyrolyzer to ascertain the level of heavy metals and alkalis. Three elements were measured: mercury, arsenic, and selenium. A typical pyrolysis temperature in the range of about 900°-1000° F. produced char that had percentage reductions of 75-80, 25-30 and 25-30 for mercury, arsenic, and selenium respectively from that of raw feed coal. In particular the mercury values appeared promising. Such heavy metals and alkalis would likely be recovered in the sulfur recovery unit for the subject process since they, along with sulfur compounds, were present in the recycled gas streams.

The foregoing description of the specific embodiments will so fully reveal the general nature of the invention that others can, by applying current knowledge, readily modify and/or adapt for various applications such specific embodiments without departing from the generic concept, and therefore such adaptations or modifications are intended to be comprehended within the meaning and range of equivalents of the disclosed embodiments. It is to be understood that the phraseology or terminology herein is for the purpose of description and not of limitation.

We claim:

1. In a process for upgrading low-rank coal wherein in a first step drying said coal using a fluidized bed operating below about 350° F., in a second step pyrolyzing said coal using a fluidized bed, in a third step cooling said coal using a fluidized bed, in a fourth step coating said coal with sealant consisting essentially of condensation from said step two, the improvement comprising:

operating said second step above about 900° F. to secure an adequate amount of said sealant, operating said third step above about 220° F. to reduce moisture condensation, and operating said fourth step to secure said sealant concentration of from six to nine weight percent.

2. The product produced by the process according to claim 1.

* * * * *